United States Patent [19]

Phillips et al.

[11] 4,124,924

[45] Nov. 14, 1978

[54] PROCESS FOR MAKING SLUB YARN FROM CONTINUOUS FILAMENT YARN

[75] Inventors: Bobby M. Phillips, Kingsport; Charles E. Manning, Elizabethton, both of Tenn.

[73] Assignee: Eastman Kodak Company, Rochester, N.Y.

[21] Appl. No.: 829,391

[22] Filed: Aug. 31, 1977

[51] Int. Cl.[2] ..... D02G 1/16; D02G 3/34

[52] U.S. Cl. ..... 28/220; 28/252; 28/271; 28/273

[58] Field of Search ..... 28/220, 252, 271, 273

[56] References Cited

U.S. PATENT DOCUMENTS

| | | | |
|---|---|---|---|
| 3,093,878 | 6/1963 | Fieldman | 28/252 |
| 3,122,816 | 3/1964 | Rhoden | 28/252 |
| 3,309,752 | 3/1967 | Nuissl | 28/252 |
| 3,312,052 | 4/1967 | Shiranezawa et al. | 28/271 X |
| 3,328,863 | 7/1967 | Cobb et al. | 28/273 |
| 3,381,346 | 5/1968 | Benson | 28/273 |
| 3,688,358 | 9/1972 | Kashima et al. | 28/273 |
| 3,854,313 | 12/1974 | Heichlinger et al. | 28/252 |

FOREIGN PATENT DOCUMENTS

| | | | |
|---|---|---|---|
| 5,030,740 | 10/1975 | Japan | 28/271 |
| 5,123,614 | 7/1976 | Japan | 28/271 |

*Primary Examiner*—Robert Mackey

*Attorney, Agent, or Firm*—Malcolm G. Dunn; D. B. Reece, III

[57] ABSTRACT

Method by which slubs are formed from random individual filaments in a continuous filament yarn bundle. A yarn bundle is fed under drafting tension to and through a first fluid jet device in which cocurrent and countercurrent fluid flows therethrough and which along with the drafting tension serves to break some of the individual filaments of the yarn bundle at random intervals along the length of the yarn bundle. The drafting tension also serves to prevent the broken filaments from completely entangling with the yarn bundle. The yarn bundle then passes through a second fluid jet device having cocurrent and countercurrent fluid flows therethrough, the flows adjusted to cause the broken filaments to slide along the yarn bundle and to become entangled with the other filaments and to form slubs. In an alternate embodiment, a second continuous filament yarn bundle may be joined to the first yarn bundle after the first fluid jet device so that the subsequent entanglements and slub formations may bind together both yarn bundles to provide broader textile utility for the final product.

5 Claims, 4 Drawing Figures

PROCESS FOR MAKING SLUB YARN FROM CONTINUOUS FILAMENT YARN

BACKGROUND OF THE INVENTION

The present invention is directed to a method by which a slub yarn may be formed from continuous filament yards.

Slub yarns are useful in providing novel effects for many areas of the textile industry. They are usually made by programmed overfeeds of two separate ends of flat filament yarn of any cross section to an intermingling device, such as a lofting jet, or by single or dual end feed to a random air jet process.

The Myers patent, U.S. Pat. No. 3,433,007, discloses one manner of forming a slub yarn. A continuous filament yarn is overfed continuously to the entrance of an aspirating jet device, and is also continously withdrawn from the entrance. The aspirating fluid stream in the jet device pulls the yarn into the jet device under tension, forms a loop in the yarn and entangles it. In this manner, the jet device forms random length and random thickness slubs at random intervals along the yarn.

The present invention is different from the Myers disclosure in that slubs are formed from individual filaments instead of the whole yarn. Also, the manner of forming the slubs is different.

The Shiranezawa et al patent, U.S. Pat. No. 3,312,052, discloses a different method from the Myers disclosure in that individual filaments of the continuous filament yarn are cut at various points along the length of the yarn to form free fiber ends, the free fiber ends then being entangled and interentangled to form slubs by passing the yarn into a fluid jet device having a turbulent fluid system. The yarn does not necessarily have to be overfed to the jet device so that slubs may be formed.

In the present invention, individual filaments are broken instead of being cut. The process disclosed thus also requires simpler apparatus to carry out the process than what would be required in the Shiranezawa et al disclosure.

Although the Williams et al patent, U.S. Pat. No. 3,007,298, teaches breaking filaments, such breaking is for a different purpose and results in a different effect. In Williams et al, a staple fiber yarn is produced from a continuous filament yarn. The continuous filament yarn is passed into a fluid jet in which the turbulence is increased to such extent so as to cause individual filaments to be torn and broken at intervals along their lengths as the filaments are whipped about in the turbulent fluid stream. The filaments are then drawn out of the turbulent stream at a speed lower than that at which they were fed to it. In addition to the turbulent stream of fluid breaking the filaments, loops, whorls, and convolutions are also formed in the filaments. The patent also teaches that the breakage may be facilitated by the interior of the jet device being formed with abrasive surfaces adapted to be engaged by the filaments as they are whipped about by the turbulent stream. The final or resulting product has an appearance somewhat like that of a spun yarn. There is no disclosure or suggestion of any slubs being formed from the broken filaments as in the manner disclosed in the present invention.

In the present invention, no loops, whorls or convolutions can be formed in the yarn bundle as in the Williams et al disclosure, because the yarn bundle is under drafting tension as it passes through the first fluid jet device. The fluid jet device also is operated under conditions to prevent such from being formed so as to prevent roll wraps on the drafting roll following the first fluid jet device.

SUMMARY OF THE INVENTION

The invention is directed to a method by which a slub yarn is formed from a yarn bundle of individual continuous filaments. The yarn bundle is fed from a source of supply to and through a fluid jet device having cocurrent and countercurrent fluid flows therethrough. The fluid flows serve to randomly break some of the individual filaments at random intervals along the length of the yarn bundle. A drafting force, however, is exerted on the yarn bundle sufficient a) to enhance filament breakage and b) to prevent the broken filaments from completely entangling with the yarn bundle. It should be especially noted that the drafting force is exerted on the yarn bundle at the same time as the yarn bundle is passing through the jet device, and is exerted under ambient rather than heated temperature conditions. The lower temperature drafting condition, in particular with respect to poly(ethylene terephthalate) yarn, thus serves to facilitate filament breakage. The drafting force is preferably exerted between two moving surfaces, the linear speeds of which are adjusted such that the drafting force is no more than 1.2 grams per denier.

The yarn bundle with the nonentangled broken filaments is then passed through a second fluid jet device having cocurrent and counter-current fluid flows therethrough. The fluid flows are adjusted so as to cause the broken filaments to slide along the yarn bundle and to become entangled with the yarn bundle and to form them into slubs. The yarn bundle is taken up from the second fluid jet device at a slower speed than the speed at which the yarn bundle enters the second fluid jet device.

The first fluid jet device is adjusted so that about 25% of the volume of fluid flow is flowing countercurrent to the direction of movement of the yarn bundle passing through the fluid jet device and about 75% of the volume of fluid is flowing cocurrent.

The second fluid jet device is adjusted so that about 50% of the volume of fluid flow is countercurrent to the direction of yarn bundle movement through the device and about 50% cocurrent.

The fluid flow for the first fluid jet device is about 5–20 S.C.F.M. (standard cubic feet per minute) at about 20–100 p.s.i.g.; and for the second fluid jet device is about 8–30 S.C.F.M. (standard cubic feet per minute) at about 50–200 p.s.i.g.

DESCRIPTION OF THE PREFERRED EMBODIMENT

Figure 1:
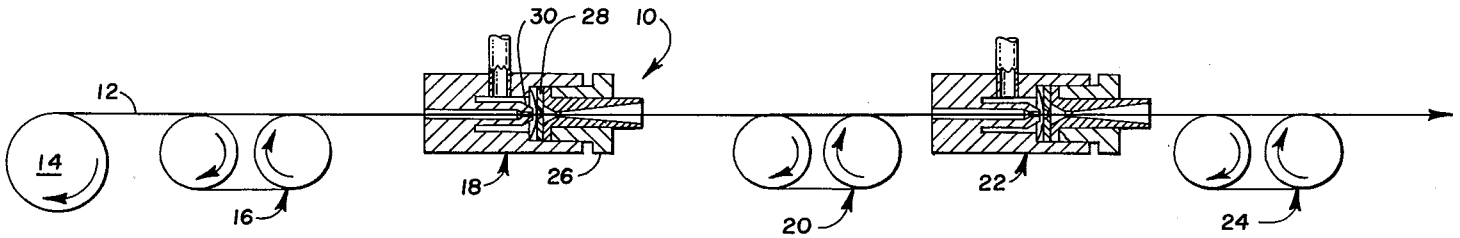
FIG. 1 is a schematic diagram of the apparatus used for practicing the method of the invention.

In reference to FIG. 1 of the drawings, the overall apparatus is shown at 10. The continuous filament yarn bundle 12 may be supplied from a supply roll 14 or from any other suitable source. The yarn bundle may then be fed to and around a first set of drafting rolls 16, fed into and through a first fluid jet device 18 and then to and around a second set of drafting rolls 20, the latter rotating at a greater speed than the first drafting roll set so as to exert a force on the yarn bundle as it passes through the first fluid jet device. The number of wraps that the yarn makes around each set of drafting rolls should be sufficient to prevent slippage of the yarn bundle.

The yarn bundle then passes into and through a second fluid jet device 22 and to and around a set of feed rolls 24 for subsequent take-up by a yarn winding apparatus (not shown). The linear speed of the feed rolls is less than the linear speed of the yarn bundle when it enters the second fluid jet device.

Each of the first and second fluid jet devices may have a construction closely resembling the structure disclosed in the Dyer patent, U.S. Pat. No. 2,924,868. The fluid jet device is preferably T-shaped, although the jet device is not necessarily limited to being T-shaped. In reference to the first fluid jet device 18, the countercurrent and cocurrent fluid flows through the jet device may be adjusted by means of the threaded plug 26. The movement of the threaded plug toward or away from the orifice plate 28 causes the distance between the nozzle or nozzle tip 30 and the orifice plate to be varied or adjusted. For instance, the following table illustrates the consequence of a few of such adjustments:

| CounterCurrent* | % CoCurrent | Distance Between Nozzle and Orifice Plate |
|---|---|---|
| 0 p.s.i.g. | 100% | 0.051 inch |
| 4 p.s.i.g. | about 80% | 0.055 inch |
| 8 p.s.i.g. | about 60% | 0.059 inch |
| 12 p.s.i.g. | about 40% | 0.076 inch |

*From a system having a maximum air pressure of 20 p.s.i.g.

The invention is not limited to the use of the particular jet device shown in the drawings or in the Dyer patent since obviously other jet device constructions may be used. The Dyer jet device as illustrated, however, may be inverted so that the yarn enters what was previously the yarn exit end in order, if desired, to obtain a 0 percent cocurrent flow and a 100 percent countercurrent flow. The nozzle opening may also be enlarged. All of this discussion is only to establish that the jet device per se is not the invention, but rather the overall concept of how applicants' invention may be accomplished.

Since the elements of the second fluid jet device 22, as shown in FIG. 1, are the same as the first fluid jet device, no reference numbers are shown pointing out the different elements in the second fluid jet device.

Figure 2A:
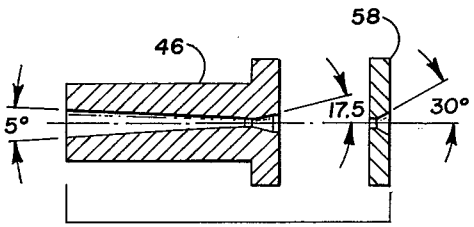
FIG. 2A is a cross-sectional view in elevation of an exploded detail of the venturi and the orifice plate shown in FIG. 2.
Figure 2:
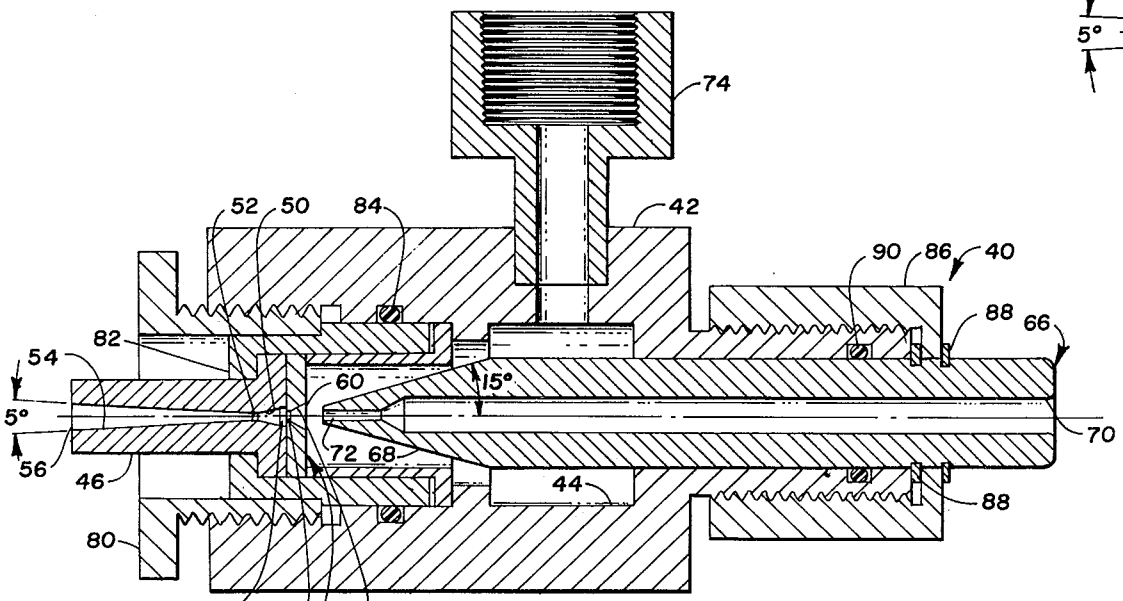
FIG. 2 is an enlarged cross-sectional view in elevation of the form of fluid jet device that may be used for the second fluid jet device.

The particular construction of the second fluid jet device shown in FIG. 1 may also be replaced by the particular construction of fluid jet device shown at 40 in FIG. 2. In reference, therefore, to FIGS. 2 and 2A, the fluid jet device 40 has an elongated housing 42 provided with a central bore 44, which also defines in part a plenum chamber for receiving therein a fluid such as a gaseous fluid like air.

A venturi 46 is supported in the central bore in the exit end of the housing and has a passageway extending through the venturi with a central entry opening 48, a converging wall portion 50, a constant diametered throat 52 with a length nearly the same as the diameter, a diverging wall portion 54 and a central exit opening 56.

An orifice plate 58 is supported in the central bore and abuts against the inner end of the venturi in the manner shown. The orifice plate has a central entry opening 60, which is concentric with the central entry opening of the venturi, and the wall 62 of the entry opening has an inwardly tapering bevel terminating in an exit opening 64.

A yarn guiding needle 66 is also positioned in the central bore of the housing and has an inner end portion 68 spaced closely adjacent the central entry opening of the orifice plate. The needle has an axial yarn guiding passageway 70, which extends through the needle and terminates in an exit opening 72. The outer wall of the inner end portion of the needle adjacent the exit opening 72 is inwardly tapered toward the orifice plate in the manner shown.

An inlet or conduit 74 serves to introduce the gaseous fluid, such as air, into the plenum chamber of the central bore 44 of the housing 42.

The venturi 46 may be held in position within the central bore by a threaded plug 80.

As shown, the inward taper of the outer wall of the needle inner end portion 68 is about 15° relative to the axis of the axial yarn guiding passageway 70. The needle exit opening has a diameter of about 0.025 inch.

The wall of the central entry opening 60 of the orifice plate 58 has an inwardly tapering bevel of about 30° relative to the axis of the entry opening 62, the exit opening 64 has a diameter of about 0.031 inch, and the length of such exit opening is about 0.010 inch. The thickness of the orifice plate is about 0.063 inch.

The constant diametered throat 52 of the venturi 46 extends inwardly from the central entry opening 48 by a distance of about 0.094 inch; the throat has a length of about 0.031 inch and a diameter of about 0.033 inch. The Dyer patent discusses the significance of having a throat having some length to it. The converging wall portion 50 of the venturi has an angle of about 17.5° relative to the axis of the central entry opening of the venturi and the venturi central entry opening has a diameter of about 0.062 inch. The diverging wall portion of the venturi exit opening is about 5° or has a half angle of about 2.5° relative to the axis of the exit opening.

A holder 82 aids in holding the venturi in position in addition to the corresponding use of the threaded plug 80, while an O-ring 84 provides a gas-tight seal in known manner with the holder to prevent gas from escaping the plenum chamber.

The yarn guiding needle 66 is adjustably spaced within the central bore 44 from the orifice plate 58 by means of the threaded member 86. The needle is secured to the threaded member by means of cooperating grooves and retaining rings 88. O-ring 90 serves as a gas seal in a known manner. Rotation of the threaded member 86 serves to adjust the spacing of the needle relative to the orifice plate 58.

In practicing one example of the process by the apparatus disclosed in FIG. 1, one end of 90 (total denier)/30 filaments round cross section polyester filament yarn having a residual elongation at 12% was plied with a 70/36 round polyester yarn with a residual elongation at 35%, and fed at 196 meters per minute through the first fluid jet device 18, which was (adjusted to a 5 p.s.i.g. blowback) operating at 40 p.s.i.g., to the second drafting rolls 20 turning at 200 meters per minute (2% underfeed). The output from the second drafting rolls was then fed through the second fluid jet device 22 (adjusted to 10 p.s.i.g. blowback) operating at 100 p.s.i.g. and then to the third set of rolls 24 turning at 196 meters per minute (2% overfeed) and taken up at that speed. The yarn produced had a very slubby appearance.

In a second example, the only change made was to operate the first fluid jet device 18, at 20 p.s.i.g. A fewer number of slubs were produced in this yarn.

In a third example, the yarn bundle was 150 (total denier)/30 filaments polyester and was underfed at 190 meters per minute through the first fluid jet device 18, which was (adjusted to 5 p.s.i.g. blowback) operating at 160 p.s.i.g., to the second set of drafting rolls 20 operating at 200 meters per minute. The yarn bundle was then passed through the second fluid jet device 22, which as (adjusted to 10 p.s.i.g. blowback) operating at 160 p.s.i.g., to a take-up system (not shown) operating at 196 meters per minute. The yarn produced has about one (1) slub per meter.

Figure 3:
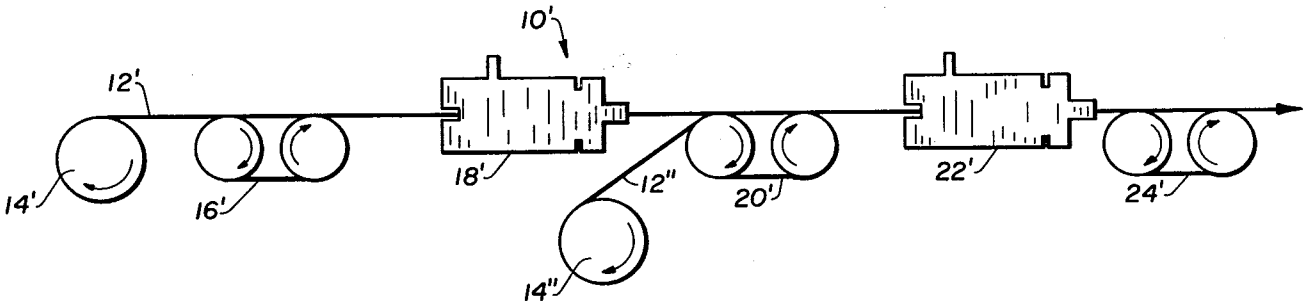
FIG. 3 is a schematic diagram of another embodiment of the apparatus used for practicing the invention.

In reference to FIG. 3, a second supply roll 14'' may be used to introduce a second continuous filament yarn bundle 12'' upstream of the second pair of drafting rolls 20' for joining the first yarn bundle 12' and thereby provide broader textile utility for the final yarn so that it may be used in a variety of fabric making machinery. As such two yarn bundles pass through the second fluid jet device 22', the broken filaments of the first yarn bundle are entangled to make slubs with both yarn bundles.

All other reference numbers in FIG. 3 which identify the same elements shown in FIG. 1 and previously described have prime marks thereafter.

The invention has been described in detail with particular reference to certain preferred embodiments thereof, but it will be understood that variations and modifications can be effected within the spirit and scope of the invention.

We claim:

1. Method for making a slub yarn, the method comprising:

(a) feeding a yarn bundle of individual continuous filaments from a source of supply to and through a first fluid jet device having cocurrent and countercurrent fluid flows therethrough and thereby randomly breaking some of the individual filaments at random intervals along the length of the yarn bundle, (b) maintaining at the same time a drafting force on the yarn bundle sufficient to prevent the broken filaments from entangling with the yarn bundle and to enhance filament breaking, the drafting force being exerted under ambient temperature conditions between two moving surfaces, the linear speeds of which are adjusted such that the drafting force is no more than 1.2 grams per denier;

(c) passing the yarn bundle with the nonentangled broken filaments to and through a second fluid jet device having cocurrent and countercurrent fluid flows therethrough and by such fluid flows sliding the broken filaments along the yarn bundle and entangling them with the yarn bundle and thereby forming the broken filaments into slubs; and (d) taking up the yarn bundle at a slower speed than the speed at which the yarn bundle enters the second fluid jet device.

2. Method as defined in claim 1, wherein the fluid flows are compressed gasses.

3. Method as defined in claim 1, wherein said first fluid jet device has about 25% of the volume of fluid flow flowing countercurrent to the direction of movement of the yarn bundle and about 75% of the volume of fluid flow flowing cocurrent, and said second fluid jet device has about 50% of the volume of fluid flow flowing countercurrent and about 50% of the volume of fluid flow flowing cocurrent.

4. Method as defined in claim 3, wherein the fluid flow for said first fluid jet device is about 5–20 S.C.F.M. at about 20–100 p.s.i.g. and for said second fluid jet device is about 8–30 S.C.F.M. at about 50–200 p.s.i.g.

5. Method as defined in claim 1, wherein a second yarn bundle of individual continuous filaments is fed from a separate source of supply to join the first-mentioned yarn bundle prior to the latter passing through the second fluid jet device, and wherein the broken filaments of the first-mentioned yarn bundle are entangled to make aesthetically desirable slubs with both the first-mentioned and second yarn bundles as the two yarn bundles pass together through the second fluid jet device.

* * * * *